US006776383B2

(12) United States Patent
Lanka

(10) Patent No.: US 6,776,383 B2
(45) Date of Patent: Aug. 17, 2004

(54) VEHICLE BRACING APPARATUS AND METHOD FOR USE

(76) Inventor: Richard Lanka, 1790 Enterprise Pkwy., Twinsburg, OH (US) 44087

( * ) Notice: Subject to any disclaimer, the term of this patent is extended or adjusted under 35 U.S.C. 154(b) by 0 days.

(21) Appl. No.: 10/225,961

(22) Filed: Aug. 22, 2002

(65) Prior Publication Data

US 2003/0189154 A1 Oct. 9, 2003

Related U.S. Application Data

(60) Provisional application No. 60/373,307, filed on Apr. 8, 2002.

(51) Int. Cl.[7] ..... A47F 5/00

(52) U.S. Cl. ..... 248/352; 248/354.3; 248/354.5; 52/149

(58) Field of Search ..... 248/352, 354.3, 248/354.4, 354.5, 354.6; 52/127.2, 149, 36.4, 749.1, 749.13

(56) References Cited

U.S. PATENT DOCUMENTS

| | | | | | |
|---|---|---|---|---|---|
| 1,209,398 | A | * | 12/1916 | Converse | 280/14 |
| 2,725,210 | A | * | 11/1955 | Swartz | 248/354.3 |
| 2,832,559 | A | * | 4/1958 | Hillberg | 254/100 |
| 3,006,592 | A | * | 10/1961 | Davis, Jr. | 248/354.3 |
| 3,171,627 | A | * | 3/1965 | Tapley et al. | 248/354.3 |
| 3,750,349 | A | * | 8/1973 | Deike | 52/23 |
| 5,186,429 | A | | 2/1993 | Linnepe et al. | |
| 5,238,213 | A | | 8/1993 | Pool | |
| 5,314,157 | A | | 5/1994 | Linnepe et al. | |
| 5,351,926 | A | * | 10/1994 | Moses | 248/354.5 |
| 5,413,303 | A | | 5/1995 | Lee | |
| 5,575,492 | A | * | 11/1996 | Stone | 280/475 |
| 5,850,718 | A | * | 12/1998 | MacKarvich | 52/292 |
| 6,065,254 | A | * | 5/2000 | Lanka | 52/127.2 |
| 6,158,705 | A | * | 12/2000 | Cudmore et al. | 248/354.1 |
| 6,256,940 | B1 | * | 7/2001 | MacKarvich | 52/126.6 |
| 6,282,856 | B1 | * | 9/2001 | MacKarvich | 52/299 |

OTHER PUBLICATIONS

PARATECH brochure, 3/99 (4 pages); Paratech Rescue Support Systems—http://www.paratech–inc.com/Rescue-Support.asp (4 pages).

AIRSHORE brochure—ART Lite Vehicle Stabilization Kit (11 pages); Airshore International–ART Lite—http://www.airshore.com/tech/art_lite.htm (4 pages).

Howell Rescue Systems—http://www.howellrescue.com/capabear_claw_hd_kit1.htm (4 pages).

Res–Q–Jack™ Vehicle Stabilization—http://www.cepcotool.com/special/homebottom.htm (8 pages).

* cited by examiner

*Primary Examiner*—Korie Chan
(74) *Attorney, Agent, or Firm*—Fay, Sharpe, Fagan, Minnich & McKee, LLP

(57) ABSTRACT

A brace for stabilizing a vehicle is provided. The brace includes a main tube including a first end and a second end and defining at least one first set of orifices. An extension tube is disposed in the main tube from the first end and defines at least one second set of orifices. The position of the extension tube is set by selectively aligning at least one set of orifices from the first set and at least one set of orifices from the second set and inserting a fastener through the aligned orifices. A vehicle anchor is removably connected to the extension tube and a footer is removably connected to the second end of the main tube. A method for using a brace to stabilize a vehicle is also provided.

16 Claims, 7 Drawing Sheets

VEHICLE BRACING APPARATUS AND METHOD FOR USE

CROSS REFERENCE TO RELATED APPLICATION

This application claims the benefit of U.S. Provisional application Serial No. 60/373,307, filed on Apr. 8, 2002.

FIELD OF THE INVENTION

The present invention relates to the art of bracing systems that are used to stabilize vehicles. More particularly, the present invention relates to a bracing system for use in stabilizing a vehicle in an emergency situation.

BACKGROUND OF THE INVENTION

When an automobile, truck or other vehicle is in an accident, there are times when the vehicle comes to rest on its side or its roof, or against an object such as a tree, pole or another vehicle. The vehicle must be stabilized in order to allow rescue workers to remove the driver and passengers. In order to prevent further injury to the occupants of the vehicle as well as damage to the vehicle, it must be stabilized in the position at which it has come to rest.

Because of the wide variety of positions to which a vehicle may come to rest, it is necessary to have a stabilization or bracing system that is adaptable to various positions and heights. In addition, stabilization is a task that is typically performed by rescue personnel as they prepare to remove the occupants from the vehicle. As a result, a bracing system must be capable of being assembled quickly and easily.

Moreover, there are instances in which a significant portion of the weight of the vehicle must be supported by the brace, necessitating an apparatus or system that can support a large amount of weight. As a brace is typically used repeatedly throughout its lifetime, durability is also required.

It is necessary for a bracing system to be transported easily, so that the rescue workers can quickly bring the brace from an emergency vehicle to the vehicle to be supported. As a result, the weight of the brace must be minimized and the components must be compact.

Bracing systems of the prior art include wood, such as four-by-four (4×4) beams that are wedged in between a stable surface, such as the ground, and the area of the vehicle to be supported. These systems lack adjustability and are not durable, often being discarded after one use.

Other braces of the prior art include metal members that rely on pneumatic pressure to position and/or stabilize the brace against the vehicle. However, it is desirable to reduce reliance on pneumatic means due to the strength limitations of pneumatic cylinders and the long-term durability of such cylinders. In addition, the use of pneumatic cylinders increases the cost of the systems, leading to undesirable economic results when governments purchase the systems for rescue departments.

Still other systems of the prior art rely on mechanical cranks to position and stabilize the brace. The increased amount of components involved in a crank system leads to the disadvantage of an increased possibility of failure of a component, decreasing the life of the brace. The use of additional components for a crank also leads to increased cost, again leading to undesirable economic results for the purchasers of these bracing systems.

It is therefore desirable to develop a brace for a vehicle that is strong, durable, adjustable and reusable, yet economical and easy to set up and to transport.

BRIEF SUMMARY OF THE INVENTION

In an exemplary embodiment of the present invention, a brace for stabilizing a vehicle is provided. The brace includes a main tube including a first end and a second end and defining at least one first set of orifices. An extension tube is disposed in the main tube from the first end and defines at least one second set of orifices. The position of the extension tube is set by selectively aligning at least one set of orifices from the first set and at least one set of orifices from the second set and inserting a fastener through the aligned orifices. A vehicle anchor is removably connected to the extension tube and a footer is removably connected to the second end of the main tube.

In another exemplary embodiment of the present invention, a brace for stabilizing a vehicle is provided. The brace includes a main tube including a first end, a second end and a fine adjuster including a screw, and defines at least one first set of orifices. An extension tube is disposed in the main tube from the first end and defines at least one second set of orifices. The position of the extension tube is set by selectively aligning at least one set of orifices from the first set and at least one set of orifices from the second set and inserting a fastener through the aligned orifices. A vehicle anchor is removably connected to the extension tube and a footer is removably connected to the second end of the main tube. The footer includes at least one set of parallel flanges that define at least one set of orifices.

In yet another exemplary embodiment of the present invention, a method for using a brace to stabilize a vehicle is provided. The method includes the steps of providing a main tube defining at least one first set of orifices, providing an extension tube disposed in the main tube and defining at least one second set of orifices, sliding the extension tube out of the main tube to a desired length, aligning at least one set of the first set of orifices and one set of the second set of orifices, securing the position of the extension tube in the main tube, positioning an anchor that is connected to the extension tube against the vehicle to be stabilized, and positioning a footer that is connected to the main tube on a stable surface.

There are other objects and features of the invention, which will be apparent from the following description and claims.

BRIEF DESCRIPTION OF THE FIGURES

The following is a brief description of the drawings, which are presented for the purpose of illustrating the invention and not for the purpose of limiting the same, and wherein.

DETAILED DESCRIPTION OF THE INVENTION

Figure 1:
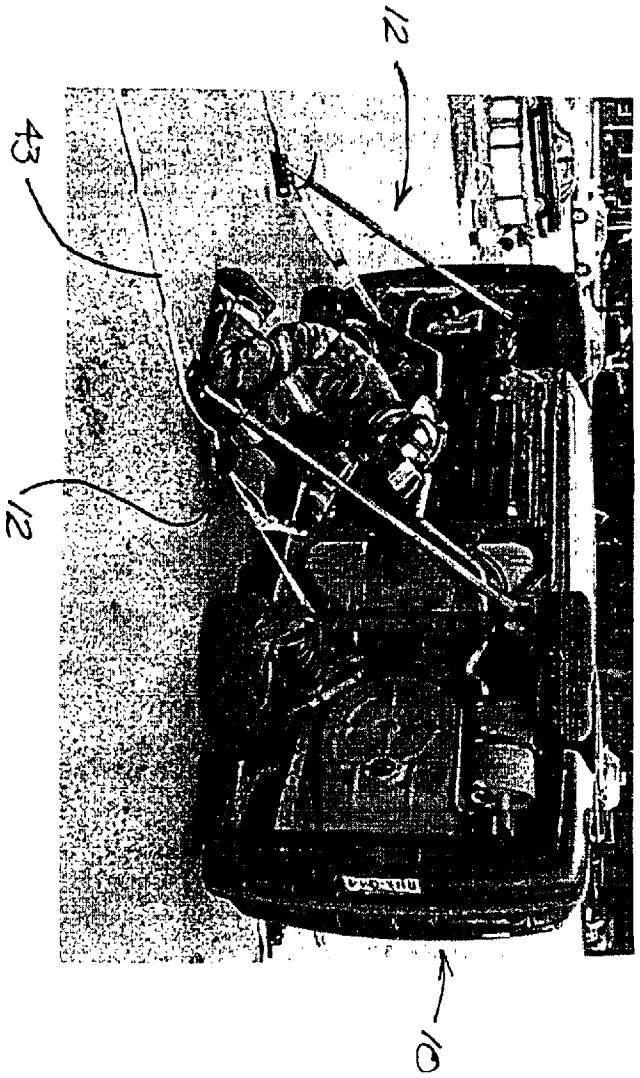
FIG. 1 is a perspective view of a bracing system in accordance with one embodiment of the invention in use.

Referring now to the drawings, wherein the showings are for purposes of illustrating preferred embodiments of the invention and not for the purpose of particularly limiting the same, FIG. 1 illustrates a vehicle 10 on its side and in need of stabilization. A rescue worker places braces 12 of the present invention to stabilize the vehicle 10.

Figure 2:
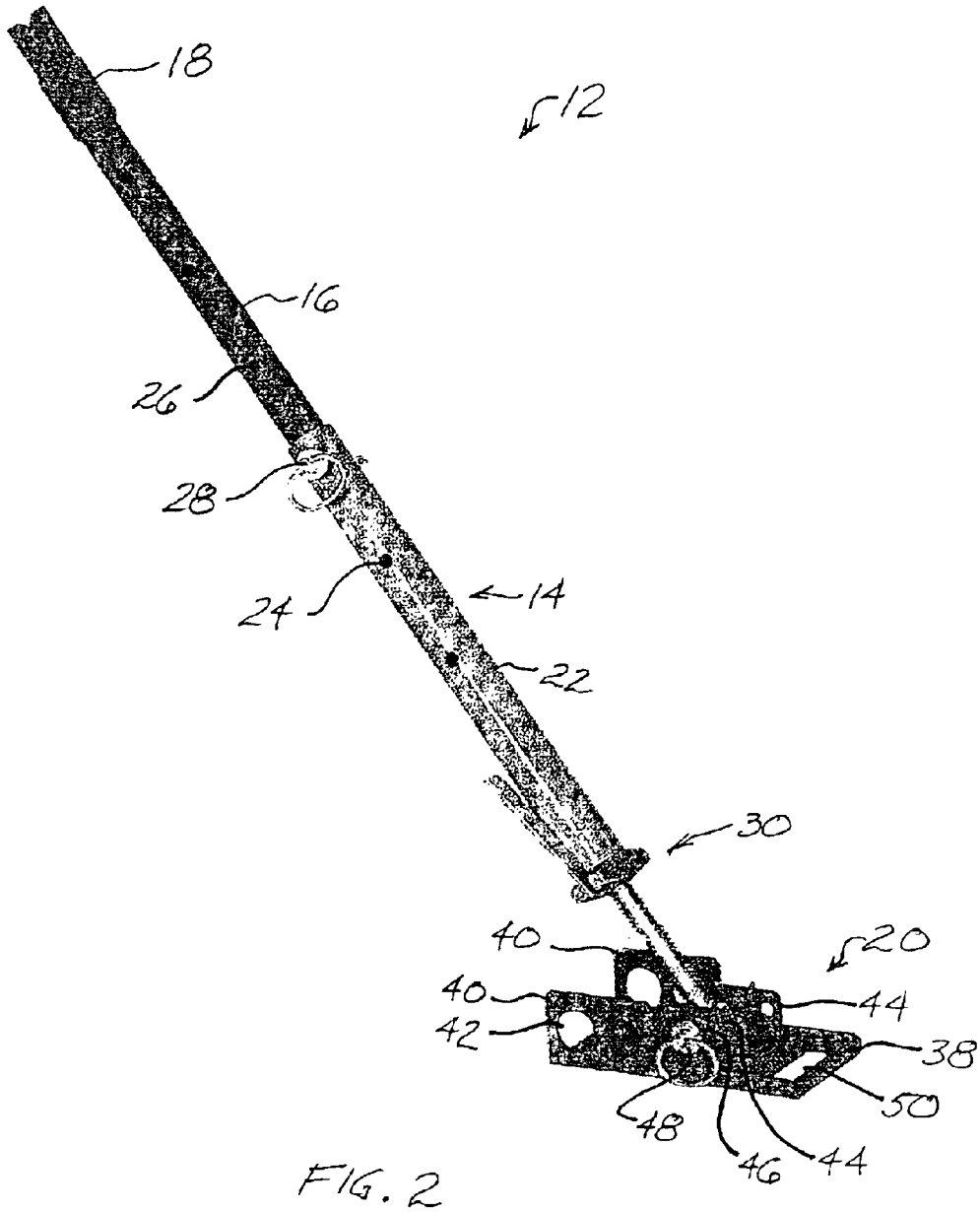
FIG. 2 is a perspective view of the bracing system of FIG. 1.

Turning to FIG. 2, the components of the brace 12 are illustrated. A main tube 14 receives an extension tube 16, to which a vehicle anchor 18 is connected. A footer 20 is connected to the main tube 14 at the opposite end of the main tube 14 from the extension tube 16. The footer 20 is placed on the ground or other stable surface. A mechanical linear member is thus created, transferring the weight of the vehicle to be stabilized down the anchor 18, down the extension tube 16, down the main tube 14 to the footer 20 and the ground.

The main tube 14 includes a body 22 that defines sets of orifices 24. The extension tube 16 is of an outer diameter that is slightly less than the inner diameter of the body 22 of the main tube 14, thereby allowing the extension tube 16 to slide inside of the main tube 14. The extension tube 16 defines sets of orifices 26 that selectively align with the orifices 24 in the main tube 16. Thus, gross adjustment of the brace 12 is facilitated by extending the extension tube 16 from the main tube 14 to a desired length and aligning a set of orifices 24 in the main tube 14 with a set of orifices 26 in the extension tube 16. A first pin 28 or other similar fastener may then be inserted through the aligned orifices to secure the position of the extension tube 16. For smaller adjustments, a fine adjuster 30 is included on the main tube 14.

Figure 3:
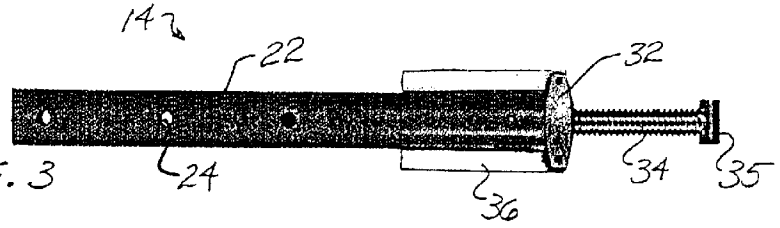
FIG. 3 is a front view of a component of the brace of FIG. 2.
Figure 4:
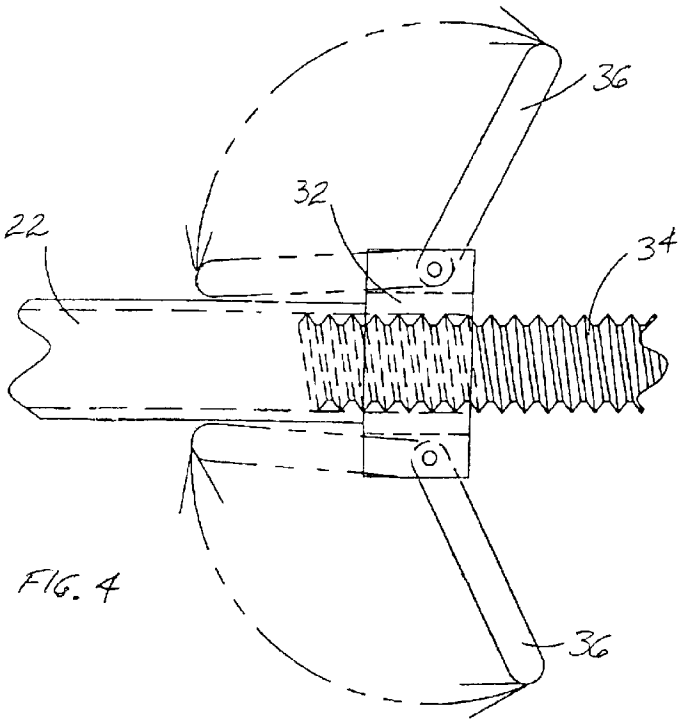
FIG. 4 is a side view, partially in section, of a portion of the component shown in FIG. 3.

With reference to FIGS. 3 and 4, the fine adjuster 30 is illustrated. A tapped collar 32 is rotatably connected to the body 22 of the main tube 14 at the end of the main tube 14 opposing the extension tube 16. A screw 34 engages the tapped collar 32 and terminates in a socket 35. The socket 35 receives a pin or other fastener, to be described below. Handles 36 are pivotally connected to the tapped collar 32 and allow the tapped collar 32 to be rotated, causing the screw 34 to move in or out of the body 22 of the main tube 14. Thus, once the brace 12 is in place or nearly in place, the handles 36 may be used to rotate the collar 32 and move the screw 34, thereby providing fine adjustment of the length of the brace 12.

Returning to FIG. 2, the footer 20 facilitates the connection of the support members to the ground. The footer 20 includes a base plate 38 that contacts the ground, while a first set of parallel flanges 40 extend from the base plate 38 in a direction normal to it. The first set of parallel flanges 40 define at least one set of orifices 42 that allow a ratchet strap assembly 43 (referring back to FIG. 1) to be connected to the footer 20. Ratchet strap assemblies 43 are known in the art and may be connected to a lower point of the vehicle 10 and to the footer 20 and then tightened to provide a triangular load-bearing system.

With continuing reference to FIG. 2, a second set of parallel flanges 44 extend from the base plate 38 in a direction normal to it and are adjacent the first set of parallel flanges 40. The second set of parallel flanges 40 define at least one second set of orifices 46. The socket 35 (FIG. 3) of the fine adjuster 30 of the main tube 14 aligns with at least one set of the second set of orifices 46. A second pin 48 or other similar fastener is inserted through the aligned socket 35 and orifices 46 to secure the footer 20 to the fine adjuster 30 of the main tube 14. It is to be noted that the first set of orifices 42 and the second set of orifices 46 may be of different diameters. For example, the first set of orifices 42 may be larger than the second set of orifices 46, which allows a strap system 43 to be connected to the footer 20 at the first set of orifices 42 easily, while the diameter of the second set of orifices 46 more closely approximates that of the second pin 48.

The base plate 38 of the footer 20 also defines a slot 50 through which a ground anchoring fastener may be driven, such as a spike or large nail. The slot 50 is defined away from the first 40 and second 44 sets of parallel flanges to allow the spike to be placed and driven without damaging the structure of the brace 12. Thus, the slot 50 facilitates easy anchoring of the brace 12 to a support surface, such as the ground.

The brace 12 is adjustable in length from about two (2) feet to about five (5) feet in order to provide support at a variety of points along a vehicle. This adjustability is provided by the main tube 14 and the extension 16 as described above, and through the use of additional extension tubes. In a basic configuration (FIG. 2), the vehicle anchor 18 slides over the end of the extension tube 16 that opposes the main tube 14. Additional extensions may be placed between the vehicle anchor 18 and the extension tube 16 to provide for increased length of the brace 12.

Figure 5:
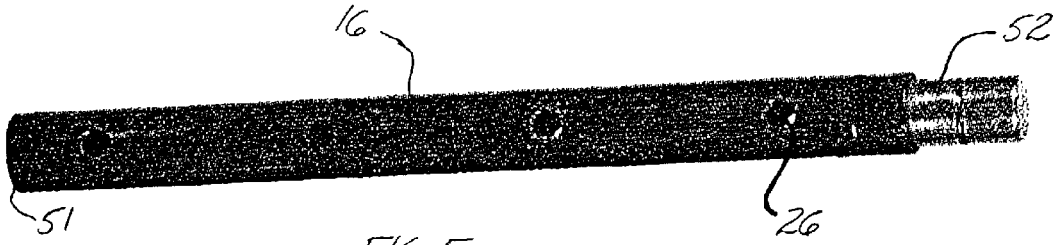
FIG. 5 is a perspective view of another component of the brace of FIG. 2.

As shown in FIG. 5, the extension tube 16 includes an end 51 that slides into the main tube 14. At the opposite end of the extension tube 16 (where the vehicle anchor 18 would be located in a basic configuration, i.e., FIG. 2), a connector 52 may be inserted into the inner diameter of the extension tube 16. It is to be noted that the vehicle anchor 18 may connect directly to the extension tube 16, as described above, or to the connector 52 when the connector 52 is present.

Figure 6:
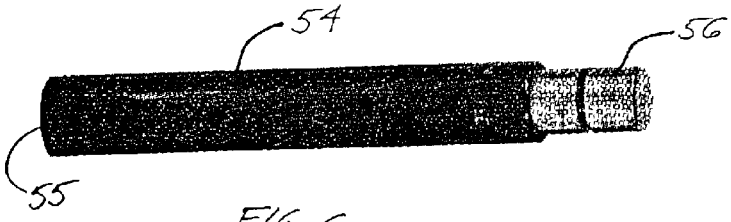
FIG. 6 is a perspective view of an alternative component of the brace of FIG. 2.

A first additional extension tube 54 is illustrated in FIG. 6. One end 55 of the first additional extension tube 54 is placed over the connector 52 of the main extension tube 16, while the opposing end may have a connector 56. The opposing end of the first additional extension tube 54 may receive the vehicle anchor 18 directly when the connector 56 is not present, or the vehicle anchor 18 may engage the connector 56 when the connector is present.

Figure 7:
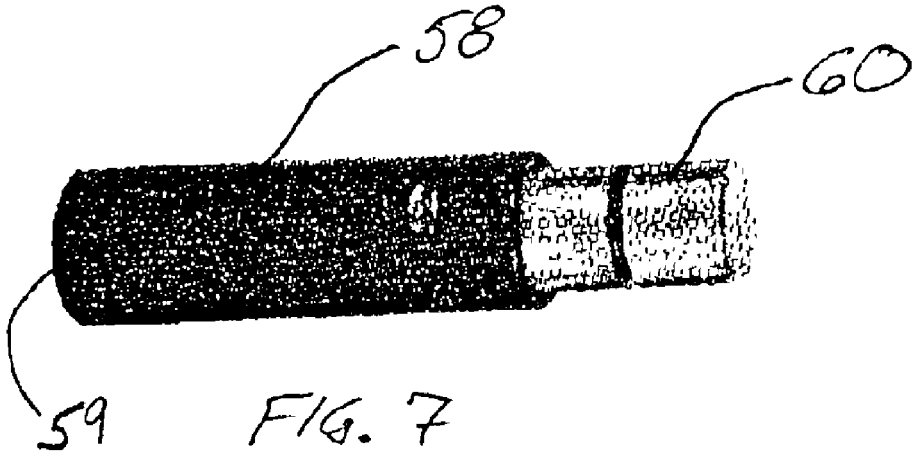
FIG. 7 is a perspective view of another alternative component of the brace of FIG. 2.

The additional extensions may include different lengths. Turning to FIG. 7, a shorter additional extension, i.e., a second additional extension tube 58, may be used. As with the first additional extension tube 54, one end 59 of the second additional extension tube 58 is placed over the connector 52 of the main extension tube 16 (or the connector of another tube, e.g., connector 56 of first additional extension 54), while the opposing end may have a connector 60. The opposing end of the second additional extension tube 58 may receive the vehicle anchor 18 directly when the connector 58 is not present, or the vehicle anchor 18 may engage the connector 58 when the connector is present.

Figure 8:
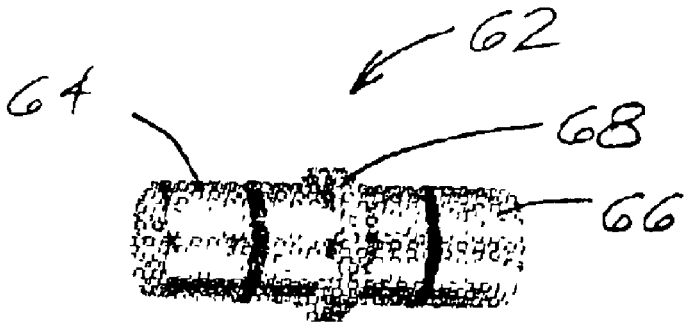
FIG. 8 is a perspective view of yet another alternative component of the brace of FIG. 2.

With reference to FIG. 8, a double male connector 62 may be used to connect the various extensions 16, 54 and 58 to one another or to the vehicle anchor 18. A first side 64 slides into one of the extensions 16, 54 and 58 and a second side 66 slides into a different extension 16, 54 and 58 or into the vehicle anchor 18. A collar 68 is of a larger diameter than the first 64 and second 66 sides and separates the sides 64 and 66, thus preventing the connector 62 from sliding completely into an extension 16, 54 and 58.

By using the various extensions 16, 54 and 58, easy adjustability of length of the brace 12 is achieved.

The vehicle anchor 18 make take several configurations, based upon the specific needs of the user of the brace 12. As mentioned above, the anchor 18 may be of an inner diameter to slide over the extensions 16, 54 and 58, the connectors 52, 56, 60 and 62, or both, to facilitate an easy connection to the remainder of the brace 12. Moreover, different styles may be used for the anchor 18.

Figure 9:
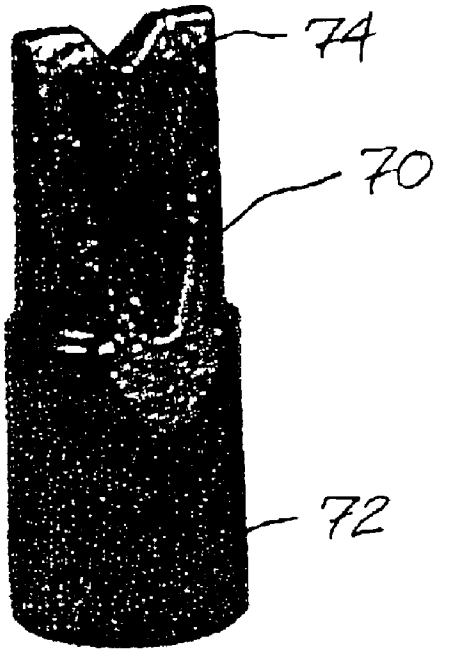
FIG. 9 is a perspective view of yet another component of the brace of FIG. 2.

For example, turning to FIG. 9, a wedge style 70 may be used to support a specific point. The wedge style 70 includes a collar 72 to engage an extension 16, 54 or 58, or a connector 52, 56, 60 or 62, and a notched tip 74 to provide a close, specific point of contact with the vehicle.

Figure 10:
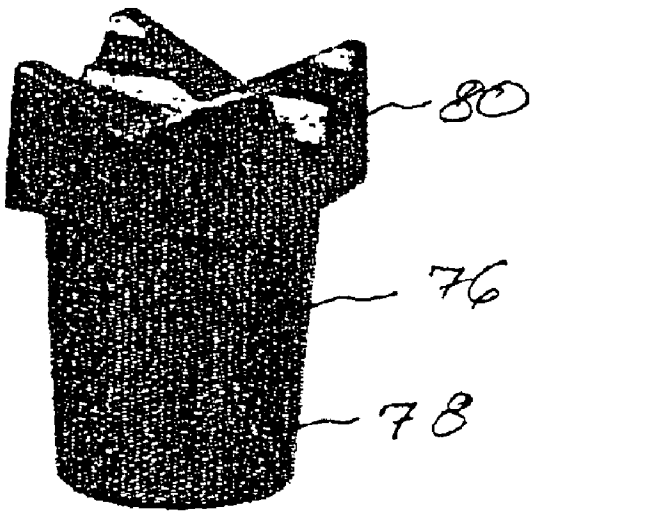
FIG. 10 is a perspective view of an alternative component of the brace of FIG. 2.

FIG. 10 illustrates a V-block style 76 for the anchor 18. A collar 78 to engage an extension 16, 54 or 58, or a connector 52, 56, 60 or 62 is included, as is a rectangular bi-dimensionally notched tip 80 to more completely surround a specific point of contact with the vehicle.

Figure 11:
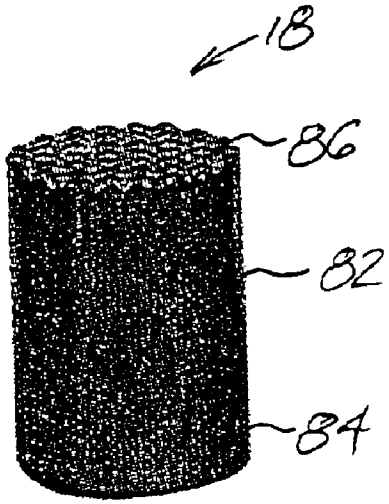
FIG. 11 is a perspective view of another alternative component of the brace of FIG. 2.

Turning to FIG. 11, a round style 82 includes a uniform outside diameter of the anchor 18. A collar 84 to engage an extension 16, 54 or 58, or a connector 52, 56, 60 or 62 is of the same diameter as the flat tip 86. The tip 86 may be textured to provide increased friction against a relatively small and flat point of contact with the vehicle.

Figure 12:
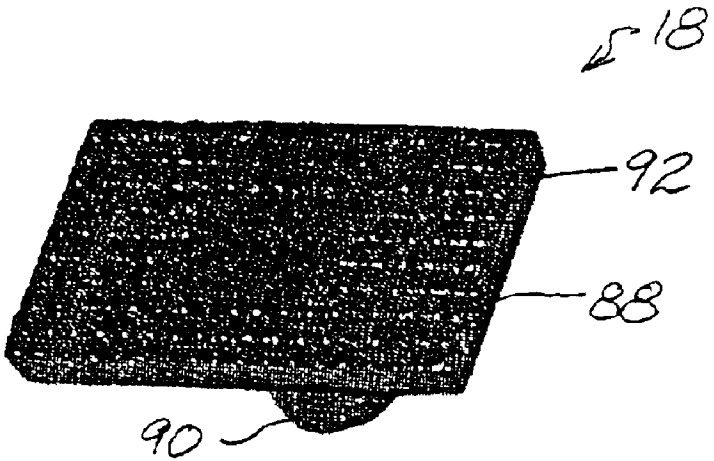
FIG. 12 is a perspective view of yet another alternative component of the brace of FIG. 2.

FIG. 12 shows a flat point style 88 for the anchor 18. A collar 90 to engage an extension 16, 54 or 58, or a connector 52, 56, 60 or 62 is included, as is a flat pad tip 92. Flat pad tip 92 may be textured to provide increased friction against a larger flat point of contact with the vehicle.

The brace 12 provides an easy-to-use mechanical system with components that are designed to reduce the probability of failure while being adaptable. As described above, the extensions 16, 54 and 58 may be used in series to extend the length of the brace 12, or only one of the additional extension tubes 54 and 58 may be used with the main extension tube 16. The pins 28 and 48 may be hardened pins, thereby providing increased strength for the system.

As is apparent from the foregoing detailed description and figures, a method for using the brace 12 is also provided.

The invention has been described with reference to preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A brace for stabilizing a vehicle, comprising:

a main tube including a first end and a second end and defining at least one first set of orifices;

an extension tube disposed in the main tube from the first end and defining at least one second set of orifices, whereby the position of the extension tube is set by selectively aligning at least one set of orifices from the first set and at least one set of orifices from the second set and inserting a fastener through the aligned orifices;

a vehicle anchor removably connected to the extension tube; and a footer removably connected to the second end of the main tube, the footer including a first set of parallel flanges defining a plurality of orifices, and a second set of parallel flanges defining a plurality of orifices, wherein the of orifices defined by the first set of parallel flanges is larger in diameter than the plurality defined by the second set of parallel flanges.

2. The brace of claim 1, wherein the fastener is a pin.

3. The brace of claim 1, further comprising at least one additional extension tube.

4. The brace of claim 1, wherein the main tube includes a fine adjuster.

5. The brace of claim 4, wherein the fine adjuster includes a screw.

6. The brace of claim 5, wherein the fine adjuster is actuated by handles.

7. The brace of claim 1, wherein the anchor is one of a wedge style, a V-block style, a round style, or a flat point style.

8. A brace for stabilizing a vehicle, comprising:

a main tube including a first end, a second end and a fine adjuster including a screw, and defining at least one first set of orifices;

an extension tube disposed in the main tube from the first end and defining at least one second set of orifices, whereby the position of the extension tube is set by selectively aligning at least one set of orifices from the first set and at least one set of orifices from the second set and inserting a fastener through the aligned orifices;

a vehicle anchor removably connected to the extension tube; and a footer removably connected to the second end of the main tube and including a first set of parallel flanges defining a plurality of orifices, and a second set of parallel flanges defining a plurality orifices, wherein the plurality orifices defined by the first set of parallel flanges is larger in diameter than the plurality orifices defined by the second set of parallel flanges.

9. The brace of claim 8, further comprising at least one additional extension tube.

10. The brace of claim 8, wherein the fine adjuster is actuated by handles.

11. The brace of claim 1, wherein the anchor is one of a wedge style, a V-block style, a round style, or a fiat point style.

12. A method for using a brace to stabilize a vehicle, comprising the steps of:

providing a main tube defining at least one first set of orifices;

providing an extension tube disposed in the main tube and defining at least one second set of orifices;

sliding the extension tube out of the main tube to a desired length;

aligning at least one set of the first set of orifices and one set of the second set of orifices;

securing the position of the extension tube in the main tube;

positioning an anchor that is connected to the extension tube against the vehicle to be stabilized; and positioning a footer that is connected to the main tube on a stable surface, wherein the footer includes a first set of parallel flanges defining a plurality orifices, and a second set of parallel flanges defining a plurality orifices, and the plurality orifices defined by the first set of parallel flanges is larger in diameter than the plurality orifices defined by the second set of parallel flanges.

13. The method for using a brace to stabilize a vehicle of claim 12, wherein the step of securing the position of the extension tube in the main tube includes inserting a pin through the aligned orifices.

14. The method for using a brace to stabilize a vehicle of claim 12, further comprising the step of turning a screw that is connected to the main tube to adjust the length of the brace.

15. The method for using a brace to stabilize a vehicle of claim 12, further comprising the step of adding an additional extension tube.

16. The method for using a brace to stabilize a vehicle of claim 12, further comprising the step of connecting one end of a strap to the vehicle to be stabilized and connecting the other end of the strap to the footer.

* * * * *